US007102599B2

(12) United States Patent
Okuzawa et al.

(10) Patent No.: US 7,102,599 B2
(45) Date of Patent: Sep. 5, 2006

(54) IDENTIFICATION METHOD FOR GENERATED POSITION OF DYNAMIC FALSE CONTOUR, PROCESSING METHOD FOR IMAGE SIGNAL, AND PROCESSING APPARATUS FOR IMAGE SIGNAL

(75) Inventors: Masahiko Okuzawa, Tokyo (JP); Toru Kimura, Tokyo (JP)

(73) Assignee: Pioneer Corporation, Tokyo (JP)

( * ) Notice: Subject to any disclaimer, the term of this patent is extended or adjusted under 35 U.S.C. 154(b) by 344 days.

(21) Appl. No.: 10/234,339

(22) Filed: Sep. 5, 2002

(65) Prior Publication Data

US 2003/0048285 A1 Mar. 13, 2003

(30) Foreign Application Priority Data

Sep. 7, 2001 (JP) ..... 2001-272591
Dec. 17, 2001 (JP) ..... 2001-382843

(51) Int. Cl.
*G09G 5/10* (2006.01)

(52) U.S. Cl. ..... 345/63; 315/169.4

(58) Field of Classification Search ..... 345/60, 345/61, 63, 89; 315/169.1, 169.2, 169.3, 315/3, 169.4
See application file for complete search history.

(56) References Cited

U.S. PATENT DOCUMENTS 6,025,818 A * 2/2000 Okano ..... 345/63
6,175,194 B1 * 1/2001 Saegusa et al. ..... 315/169.4
6,414,657 B1 * 7/2002 Kasahara et al. ..... 345/63
6,646,625 B1 * 11/2003 Shigeta et al. ..... 345/63
6,707,943 B1 * 3/2004 Gicquel et al. ..... 382/199
6,812,932 B1 * 11/2004 Kasahara et al. ..... 345/613
6,882,351 B1 * 4/2005 Morita ..... 345/690
6,965,358 B1 * 11/2005 Kasahara et al. ..... 345/63
2002/0190925 A1 * 12/2002 Awamoto et al. ..... 345/60
2004/0263539 A1 * 12/2004 Ckiaki et al. ..... 345/690
2005/0052363 A1 * 3/2005 Jeong ..... 345/63
2005/0225512 A1 * 10/2005 Yamada et al. ..... 345/63
2006/0017744 A1 * 1/2006 Yamada ..... 345/596

FOREIGN PATENT DOCUMENTS

EP 1008 980 A1 * 1/1998
EP 1 032 193 A1 * 2/2000
JP 406259034 A * 3/1993
JP 7-271325 A 10/1995
JP 2003-015589 1/2003

OTHER PUBLICATIONS

Japanese Office Action for Japanese Patent Application No. 2005-151455, Apr. 4, 2006.

* cited by examiner

*Primary Examiner*—Amare Mengistu
(74) *Attorney, Agent, or Firm*—Sughrue Mion, PLLC

(57) ABSTRACT

A dynamic false contour detector identifies a pixel where a false contour is expected to be generated based on monotony of change in gradation level, an existence of carry/borrow of the subfields, and a position of a contour. Then, a pixel value switcher switches individual gradation levels among a plurality of pixels including the pixel identified by the dynamic false contour detector. As a result, it is achieved to reduce degradation of image quality due to the dynamic false contour with a simple structure and processes.

20 Claims, 12 Drawing Sheets

FIG. 2

| GRADATION | SF WEIGHT | SF1 1 | SF2 2 | SF3 4 | SF4 8 | SF5 16 |
|---|---|---|---|---|---|---|
| 0 | | | | | | |
| 1 | | ● | | | | |
| 2 | | | ● | | | |
| 3 | | ● | ● | | | |
| 4 | | | | ● | | |
| 5 | | ● | | ● | | |
| 6 | | | ● | ● | | |
| 7 | | ● | ● | ● | | |
| 8 | | | | | ● | |
| 9 | | ● | | | ● | |
| 10 | | | ● | | ● | |
| 11 | | ● | ● | | ● | |
| 12 | | | | ● | ● | |
| 13 | | ● | | ● | ● | |
| 14 | | | ● | ● | ● | |
| 15 | | ● | ● | ● | ● | |
| 16 | | | | | | ● |
| 17 | | ● | | | | ● |
| 18 | | | ● | | | ● |
| 19 | | ● | ● | | | ● |
| 20 | | | | ● | | ● |
| 21 | | ● | | ● | | ● |
| 22 | | | ● | ● | | ● |
| 23 | | ● | ● | ● | | ● |
| 24 | | | | | ● | ● |
| 25 | | ● | | | ● | ● |
| 26 | | | ● | | ● | ● |
| 27 | | ● | ● | | ● | ● |
| 28 | | | | ● | ● | ● |
| 29 | | ● | | ● | ● | ● |
| 30 | | | ● | ● | ● | ● |
| 31 | | ● | ● | ● | ● | ● |

FIG. 3

| LOWER GRADATION LEVEL | UPPER GRADATION LEVEL |
|---|---|
| 0 | 8~31 |
| 1 | |
| 2 | |
| 3 | |
| 4 | |
| 5 | |
| 6 | |
| 7 | |
| 8 | 16~31 |
| 9 | |
| 10 | |
| 11 | |
| 12 | |
| 13 | |
| 14 | |
| 15 | |
| 16 | 24~31 |
| 17 | |
| 18 | |
| 19 | |
| 20 | |
| 21 | |
| 22 | |
| 23 | |

FIG.5A

| | | |
|---|---|---|
| P(i-1, j-1) | P(i, j-1) | P(i+1, j-1) |
| P(i-1, j) | P(i, j) | P(i+1, j) |
| P(i-1, j+1) | P(i, j+1) | P(i+1, j+1) |

FIG.5B

| | | |
|---|---|---|
| 2 | 1 | 0 |
| 1 | 0 | -1 |
| 0 | -1 | -2 |

FIG.5C

| | | |
|---|---|---|
| 1 | 0 | -1 |
| 1 | 0 | -2 |
| 1 | 0 | -1 |

FIG.5D

| | | |
|---|---|---|
| -2 | -1 | 0 |
| -1 | 0 | 1 |
| 0 | 1 | 2 |

FIG.5E

| | | |
|---|---|---|
| -1 | 0 | 1 |
| -2 | 0 | 2 |
| -1 | 0 | 1 |

FIG.5F

| | | |
|---|---|---|
| 0 | -1 | -2 |
| 1 | 0 | -1 |
| 2 | 1 | 0 |

FIG.5G

| | | |
|---|---|---|
| -1 | -2 | -1 |
| 0 | 0 | 0 |
| 1 | 2 | 1 |

FIG.5H

| | | |
|---|---|---|
| 0 | 1 | 2 |
| -1 | 0 | 1 |
| -2 | -1 | 0 |

FIG.5I

| | | |
|---|---|---|
| 1 | 2 | 1 |
| 0 | 0 | 0 |
| -1 | -2 | -1 |

FIG. 7

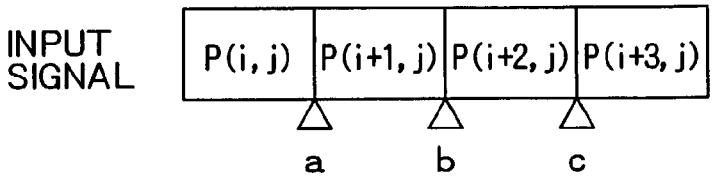

| POSITION WITH LARGE CHANGE IN DISTRIBUTION OF LIGHT EMISSION IN TERMS OF TIME | STATE OF DISTURBANCE OF IMAGE AFTER SWITCHING PIXELS |
|---|---|
| a | P(i+2, j) P(i, j) P(i+3, j) P(i+1, j) |
| b | P(i+2, j) P(i, j) P(i+3, j) P(i+1, j) |
| c | P(i+2, j) P(i, j) P(i+3, j) P(i+1, j) |
| a, b | P(i+2, j) P(i, j) P(i+3, j) P(i+1, j) |
| b, c | P(i+2, j) P(i, j) P(i+3, j) P(i+1, j) |
| c, a | P(i+2, j) P(i, j) P(i+3, j) P(i+1, j) |
| a, b, c | P(i+2, j) P(i, j) P(i+3, j) P(i+1, j) |

CASE(a) WHERE A DYNAMIC FALSE CONTOUR IS GENERATED BETWEEN P(i, j) AND P(i+1, j),
CASE(b) WHERE A DYNAMIC FALSE CONTOUR IS GENERATED BETWEEN P(i+1, j) AND P(i+2, j) AND
CASE(c) WHERE A DYNAMIC FALSE CONTOUR IS GENERATED BETWEEN P(i+2, j) AND P(i+3, j),
WHILE A CONDITION P(i, j)<P(i+1, j)<P(i+2, j)<P(i+3<j) OR A CONDITION P(i, j)>P(i+1, j)>P(i+2, j)>P(i+3, j) IS SATISFIED.

FIG. 10

| GRADATION | SF WEIGHT | SF1 1 | SF2 2 | SF3 3 | SF4 4 | SF5 5 | SF6 7 | SF7 9 |
|---|---|---|---|---|---|---|---|---|
| 0 | | | | | | | | |
| 1 | | ● | | | | | | |
| 2 | | | ● | | | | | |
| 3 | | ● | ● | | | | | |
| 4 | | ● | | ● | | | | |
| 5 | | | ● | ● | | | | |
| 6 | | ● | ● | ● | | | | |
| 7 | | ● | ● | | ● | | | |
| 8 | | ● | | ● | ● | | | |
| 9 | | | ● | ● | ● | | | |
| 10 | | ● | ● | ● | ● | | | |
| 11 | | ● | ● | ● | | ● | | |
| 12 | | ● | ● | | ● | ● | | |
| 13 | | ● | | ● | ● | ● | | |
| 14 | | | ● | ● | ● | ● | | |
| 15 | | ● | ● | ● | ● | ● | | |
| 16 | | | ● | ● | ● | | ● | |
| 17 | | ● | ● | ● | ● | | ● | |
| 18 | | ● | ● | ● | | ● | ● | |
| 19 | | ● | ● | | ● | ● | ● | |
| 20 | | ● | | ● | ● | ● | ● | |
| 21 | | | ● | ● | ● | ● | ● | |
| 22 | | ● | ● | ● | ● | ● | ● | |
| 23 | | | ● | ● | ● | ● | | ● |
| 24 | | ● | ● | ● | ● | ● | | ● |
| 25 | | | ● | ● | ● | | ● | ● |
| 26 | | ● | ● | ● | ● | | ● | ● |
| 27 | | ● | ● | ● | | ● | ● | ● |
| 28 | | ● | ● | | ● | ● | ● | ● |
| 29 | | ● | | ● | ● | ● | ● | ● |
| 30 | | | ● | ● | ● | ● | ● | ● |
| 31 | | ● | ● | ● | ● | ● | ● | ● |

FIG. 11

| GRADATION | SF WEIGHT | SF6 1 | SF4 1 2 | SF3 1 4 | SF2 1 8 | SF1 32 | SF2 2 8 | SF3 2 4 | SF4 2 2 | SF5 2 |
|---|---|---|---|---|---|---|---|---|---|---|
| 0 | | | | | | | | | | |
| 1 | | ● | | | | | | | | |
| 2 | | | | | | | | | | ● |
| 3 | | ● | | | | | | | | ● |
| 4 | | | ● | | | | | | ● | |
| 5 | | ● | ● | | | | | | ● | |
| 6 | | | ● | | | | | | ● | ● |
| 7 | | ● | ● | | | | | | ● | ● |
| 8 | | | | ● | | | | ● | | |
| 9 | | ● | | ● | | | | ● | | |
| 10 | | | | ● | | | | ● | | ● |
| 11 | | ● | | ● | | | | ● | | ● |
| 12 | | | ● | ● | | | | ● | ● | |
| 13 | | ● | ● | ● | | | | ● | ● | |
| 14 | | | ● | ● | | | | ● | ● | ● |
| 15 | | ● | ● | ● | | | | ● | ● | ● |
| 16 | | | | | ● | | ● | | | |
| 17 | | ● | | | ● | | ● | | | |
| 18 | | | | | ● | | ● | | | ● |
| 19 | | ● | | | ● | | ● | | | ● |
| 20 | | | ● | | ● | | ● | | ● | |
| 21 | | ● | ● | | ● | | ● | | ● | |
| 22 | | | ● | | ● | | ● | | ● | ● |
| 23 | | ● | ● | | ● | | ● | | ● | ● |
| 24 | | | | ● | ● | | ● | ● | | |
| 25 | | ● | | ● | ● | | ● | ● | | |
| 26 | | | | ● | ● | | ● | ● | | ● |
| 27 | | ● | | ● | ● | | ● | ● | | ● |
| 28 | | | | ● | ● | | ● | ● | ● | |
| 29 | | ● | | ● | ● | | ● | ● | ● | |
| 30 | | | ● | ● | ● | | ● | ● | ● | ● |
| 31 | | ● | ● | ● | ● | | ● | ● | ● | ● |
| 32 | | | | | | ● | | | | |
| 33 | | ● | | | | ● | | | | |
| 34 | | | | | | ● | | | | ● |
| 35 | | ● | | | | ● | | | | ● |
| 36 | | | ● | | | ● | | | ● | |
| 37 | | ● | ● | | | ● | | | ● | |
| 38 | | | ● | | | ● | | | ● | ● |
| 39 | | ● | ● | | | ● | | | ● | ● |
| 40 | | | | ● | | ● | | ● | | |
| 41 | | ● | | ● | | ● | | ● | | |
| 42 | | | | ● | | ● | | ● | | ● |
| 43 | | ● | | ● | | ● | | ● | | ● |
| 44 | | | ● | ● | | ● | | ● | ● | |
| 45 | | ● | ● | ● | | ● | | ● | ● | |
| 46 | | | ● | ● | | ● | | ● | ● | ● |
| 47 | | ● | ● | ● | | ● | | ● | ● | ● |
| 48 | | | | | ● | ● | ● | | | |
| 49 | | ● | | | ● | ● | ● | | | |
| 50 | | | | | ● | ● | ● | | | ● |
| 51 | | ● | | | ● | ● | ● | | | ● |
| 52 | | | ● | | ● | ● | ● | | ● | |
| 53 | | ● | ● | | ● | ● | ● | | ● | |
| 54 | | | ● | | ● | ● | ● | | ● | ● |
| 55 | | ● | ● | | ● | ● | ● | | ● | ● |
| 56 | | | | ● | ● | ● | ● | ● | | |
| 57 | | ● | | ● | ● | ● | ● | ● | | |
| 58 | | | | ● | ● | ● | ● | ● | | ● |
| 59 | | ● | | ● | ● | ● | ● | ● | | ● |
| 60 | | | | ● | ● | ● | ● | ● | ● | ● |
| 61 | | ● | | ● | ● | ● | ● | ● | ● | ● |
| 62 | | | ● | ● | ● | ● | ● | ● | ● | ● |
| 63 | | ● | ● | ● | ● | ● | ● | ● | ● | ● |

IDENTIFICATION METHOD FOR GENERATED POSITION OF DYNAMIC FALSE CONTOUR, PROCESSING METHOD FOR IMAGE SIGNAL, AND PROCESSING APPARATUS FOR IMAGE SIGNAL

BACKGROUND OF THE INVENTION

1. Field of the Invention

The present invention relates to an identification method for a generated position of a dynamic false contour for restraining dynamic false contours generated on a display using subfields such as a plasma display panel, a processing method for an image signal, and a processing apparatus for an image signal.

2. Description of the Related Art

As a conventional basic gradation display method, six subfields arranged in an order of luminance ratio of 1:2:4:8:16:32 are combined for representing one field with 64 gradations as described in FIG. 8 of Japanese Patent Laid-Open Publication No. Hei. 7-271325, for example. The order of turning on for sustain discharge is fixed for the six subfields, and the order is identical for the gradation levels with respect to the time axis.

However, when a motion picture is displayed with this method, there is such a problem that unevenness of light emission becomes remarkable in terms of time, and thus large disturbance occurs in the gradation when bit-carry gradation levels (such as 63 and 64, 31 and 32, and 15 and 16) exist. This disturbance in the gradation is called as a dynamic false contour.

As a result, it is necessary to identify a position where the dynamic false contour is generated, and then to conduct signal processing for restraining the dynamic false contour at the identified position to obtain proper image quality.

As a method for identifying a position where a dynamic false contour is generated, image data corresponding to one field period are stored in a frame buffer, then, image data in the next field period are compared with the image data in the stored field period, and consequently motion vectors are detected based on the comparison result.

Also, as a method for restraining the dynamic false contour, the following methods described in FIG. 16 to FIG. 23 in Japanese Patent Laid-Open Publication No. Hei. 7-271325 have been applied.

(a) A method for switching order of individual subfields (b) A method for increasing the number of subfields constituting one field so as to secure two or more types of combinations of light-emitting subfields when a gradation is represented.

Further, a method for spatially diffusing the disturbance in the gradation by signal processing such as error diffusion method is applied.

In addition, there is a method called as equalization pulse method described in "Display and Imaging" 1997, Vol. 5, pp. 229–240 as an alternative method for restraining a dynamic false contour. In this equalization pulse method, an amount for emitting light is added to or subtracted from an original signal when a disturbance of gradation is expected to be observed if the line of sight moves on a display where subfields are used, and consequently large disturbance in gradation is restrained.

However, since the method for identifying a position where a dynamic false contour is generated by detecting motion vectors requires a frame buffer with a large capacity, there is such a problem that the cost remarkably increases. Also, it is practically impossible to detect a large number of motion vectors all at once, and simultaneously, it is difficult to detect a sudden and large change of motion vectors. As a result, a detection error occurs, and consequently there is such a problem that an image is extremely degraded as the result of processing for restraining dynamic false contour based on the detection error.

Also, in the conventional processing for restraining the dynamic false contour for multi-gradation display, there are the following problems. First, when there are N subfields, it is possible to represent $2^N$ gradation levels. However, when the number of the constituting subfields is increased to more than N on a plasma display panel for restraining the dynamic false contour by reducing unevenness of light emission in terms of time, the sustain discharge period becomes short, and consequently the luminance decreases. As a result, it is impossible to increase the number of the subfields without reducing the luminance. Secondly, when the number of the divided subfields is increased, since disturbance in the gradation occurs for a specific gradation levels, it is impossible to prevent the disturbance in the gradation for the specific gradation levels.

Additionally, the signal processing for restraining the dynamic false contour by the conventional error diffusion method has the following problems. First, since the signal processing is applied to an input signal whether the dynamic false contour is generated or not, the input signal in a region where the dynamic false contour is not generated is degraded. Secondly, since there is no regularity in the disturbance in the gradation diffused by the error diffusion method, it is impossible to predict influence of the diffused disturbance in the gradation in advance.

Further, the processing for restraining the dynamic false contour by the equalization pulse method has the following problems. First, an input signal is corrected according to a motion speed of a figure for reducing disturbance of an image recognized by the eye by detecting the motion of the figure in the input signal. Since the precision of detecting the motion vectors decreases for some input image, a signal correction error may decrease the quality of the motion picture. Secondly, since it is assumed that the line of sight follows a moving figure, disturbance of the image due to the corrected signal may be recognized when the line of sight does not follow the figure.

SUMMARY OF THE INVENTION

An object of the present invention is to provide an identification method for a generated position of a dynamic false contour to reduce degradation of image quality due to the dynamic false contour with a simple structure and processes, to provide a processing method for an image signal, and to provide a processing apparatus for an image signal.

An identification method for a generated position of a dynamic false contour according to the present invention is a method for identifying a position of a dynamic false contour generated when one field period is divided into a plurality of subfields having a relative luminance ratio different from one another, and gradation is shown on a display by combining the luminance of the individual subfields. This identification method includes the step of detecting a pixel including a carry or a borrow in at least one subfield in an arrangement of gradation levels in the one field period of a plurality of pixels including this detected pixel arranged successively on the display when the gradation levels in the one field period change smoothly along the plurality of pixels.

It is preferable that only subfields with luminance higher than a predetermined value be used for determining whether the carry or borrow is included in the subfield.

An identification method for a generated position of a dynamic false contour according to the present invention is a method for identifying a position of a dynamic false contour generated when one field period is divided into a plurality of subfields having a relative luminance ratio different from one another, and gradation is shown on a display by combining the luminance of the individual subfields. This identification method includes the step of detecting a pixel with a light emission period different from that of a neighboring pixel by more than a predetermined value in the one filed period among a plurality of pixels including this detected pixel and the neighboring pixel arranged successively on the display when the gradation levels in the one field period change smoothly along the plurality of pixels.

The region where the gradation levels change smoothly is a region where the gradation levels monotonically increase or decrease, for example. Here, "monotonically increases or decreases" means a state where the gradation levels gradually increase or decrease in one direction along the arranged pixels.

It is possible to prevent blurring of a contour by determining whether the detected pixel is within a certain rage from the contour in an image in the one field period. In this case, for example, it is possible to apply filtering to the image signal representing the gradation levels of the multiple pixels including the detected pixel.

A pixel satisfying a certain condition is detected based on how the gradation levels of the successive pixels change in the present invention. Thus, since it is possible to detect a pixel on which a false contour is expected to be generated regardless of an existence of a motion on an image, it is not necessary to provide a circuit at a high cost such as a conventional frame buffer.

A processing method for an image signal according to present invention is a method for processing an image signal including the steps of dividing one field period into a plurality of subfields having a relative luminance ratio different from one another, and processing an image signal for showing gradation on a display by combining the luminance of the individual subfields. This processing method includes the step of changing an arrangement of gradation levels of a plurality of pixels arranged successively on the display such that at least a total number of carries or a total number of borrows in the subfields included in the arrangement of the gradation levels of the plurality of pixels increases from that in a supplied image signal.

In the present invention, since regions where dynamic false contours are generated are diffused, and thus they cancel out one another, it is possible to reduce degradation of image quality due to the dynamic false contour while restraining degradation of motion picture quality.

Thus, it is preferable that the step of changing the arrangement of the gradation levels set an absolute value of a difference between the total number of carries and the total number of borrows after the change of arrangement to 0 or 1. It is also preferable that the step of changing the arrangement of the gradation levels set the carry and the borrow to appear alternately in the gradation levels of the multiple pixels.

Further, for example, the step of changing the arrangement of the gradation levels may include the step of switching individual gradation levels of two pixels. In this case, when the two pixels are next to each other, since the region where the gradation levels are switched becomes narrow, it is possible to minimize the degradation of the motion picture quality.

A processing apparatus for an image signal according to the present invention is used when one field period is divided into a plurality of subfields having a relative luminance ratio different from one another, and gradation is shown on a display by combining the luminance of the individual subfields. This processing apparatus includes a pixel value switcher for changing an arrangement of gradation levels of a plurality of pixels arranged successively on the display such that at least either a total number of carries or a total number of borrows in the subfields included in the arrangement of the gradation levels of the plurality of pixels increases from that in a supplied image signal.

Additionally, a detector may be provided for detecting a pixel including a carry or a borrow in at least one subfield in the arrangement of gradation levels in the one field period of a plurality of pixels including this detected pixel arranged successively on said display, or for detecting a pixel with a light emission period in the one field period different from that of a neighboring pixel by more than a predetermined value in the one field period among the plurality of pixels including this detected pixel and the neighboring pixel arranged successively on said display, when the gradation levels in the one field period change smoothly along the multiple pixels. Since the pixel detected by the detector is included in the multiple pixels whose arrangement of gradation levels is changed by the pixel value switcher, the simple constitution without requiring a frame buffer can effectively restrain the dynamic false contours.

It is preferable that the pixel value switcher set the absolute value of a difference between the total number of carries and the total number of borrows after the change of arrangement to 0 or 1. It is also preferable that the pixel value switcher sets the carry and the borrow to appear alternately in the gradation levels of the multiple pixels.

In addition, for example, the pixel value switcher switches individual gradation levels of two pixels. In this case, it is preferable that the two pixels are next to each other.

Further, when a motion detection circuit for detecting a motion in an image by comparing the image signal for the one field period and an image signal for one field period immediately before or after the one field period, and a second detector for determining an existence of the change of the arrangement by the pixel value switcher based on both of output signals from the detector and the motion detection circuit are provided, since it is possible to detect a motion vector, a pixel on which a dynamic false contour is expected to be generated is identified more properly, and thus the dynamic false contours are restrained while the degradation of image quality is restrained.

In the present specification, the term "carry" means a case where the line of sight moves along neighboring two pixels, and the following two relationships exist between one or more subfields (a first subfield group) emitting light for representing a gradation level of the pixel on which the line of sight passes first, and one or more subfields (a second subfield group) emitting light for representing a gradation level of the pixel on which the line of sight passes next regardless of the arranged order of the subfields in the one field period.

(a) Either a subfield with the highest weight or a subfield with the second highest weight in the first subfield group is not included in the second subfield group.

(b) A subfield with a weight higher than the subfield with the highest weight in the first subfield group is included in the second subfield group.

On the other hand, the term "borrow" means a case where relationships opposite to the relationships (a) and (b) exist regardless of the arranged order of the subfields in the one field period. Thus, there is such a relationship that if a carry is generated when the line of sight moves in one direction, a borrow is generated when the line of sight moves in the opposite direction.

BRIEF DESCRIPTION OF THE DRAWINGS

FIG. 2 is a diagram showing a content of a lookup table LUT;

FIG. 3 is a diagram showing a content of a carry/borrow determination table;

FIGS. 5A through 5I are schematic diagrams showing filters used for a Robinson filter;

FIG. 7 is a diagram showing a state of diffusion of dynamic false contours in the first embodiment;

FIG. 10 is a diagram showing an example of light emission/non-light emission states when seven subfields constitute one field;

FIG. 11 is a diagram showing an example of light emission/non-light emission states when multiple subfields with the same weight are provided in one field.

DETAILED DESCRIPTION OF THE PREFERRED EMBODIMENT

Figure 1:
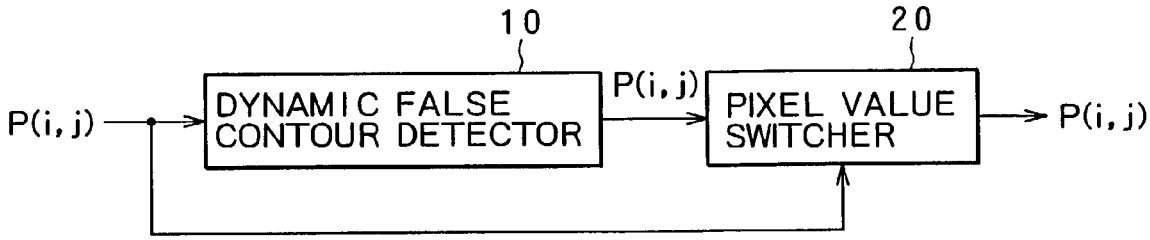
FIG. 1 is a block diagram showing a processing apparatus for an image signal according to a first embodiment of the present invention.

The following will specifically describe processing apparatuses for an image signal according to embodiments of the present invention with reference to the accompanying drawings. FIG. 1 is a block diagram showing a processing apparatus for an image signal according to a first embodiment of the present invention.

The first embodiment includes a dynamic false contour detector 10 which detects a pixel on which a dynamic false contour is expected to be generated based on image data corresponding to one field period, and a pixel value switcher 20 which switches pixel values for the pixel identified by this dynamic false contour detector 10. In addition, there is provided a lookup table LUT (not shown) which is referred to from the dynamic false contour detector 10 and the pixel value switcher 20, and records a relationship between individual gradation levels and light emission/non-light emission states of the subfields. FIG. 2 is a diagram showing a content of the lookup table LUT. FIG. 2 shows an example of light emission/non-light emission states of subfields for representing individual gradation levels when the number of the subfields is five, and thus, 32-level gradation is represented. As shown in FIG. 2, the five subfields constituting the one field are SF1, SF2, . . . , and SF5 arranged in this order, and ratio of light emission periods of the individual fields is 1:2:4:8:16. Also, the light emission state of the subfields is indicated as "•" in FIG. 2.

Figure 4:
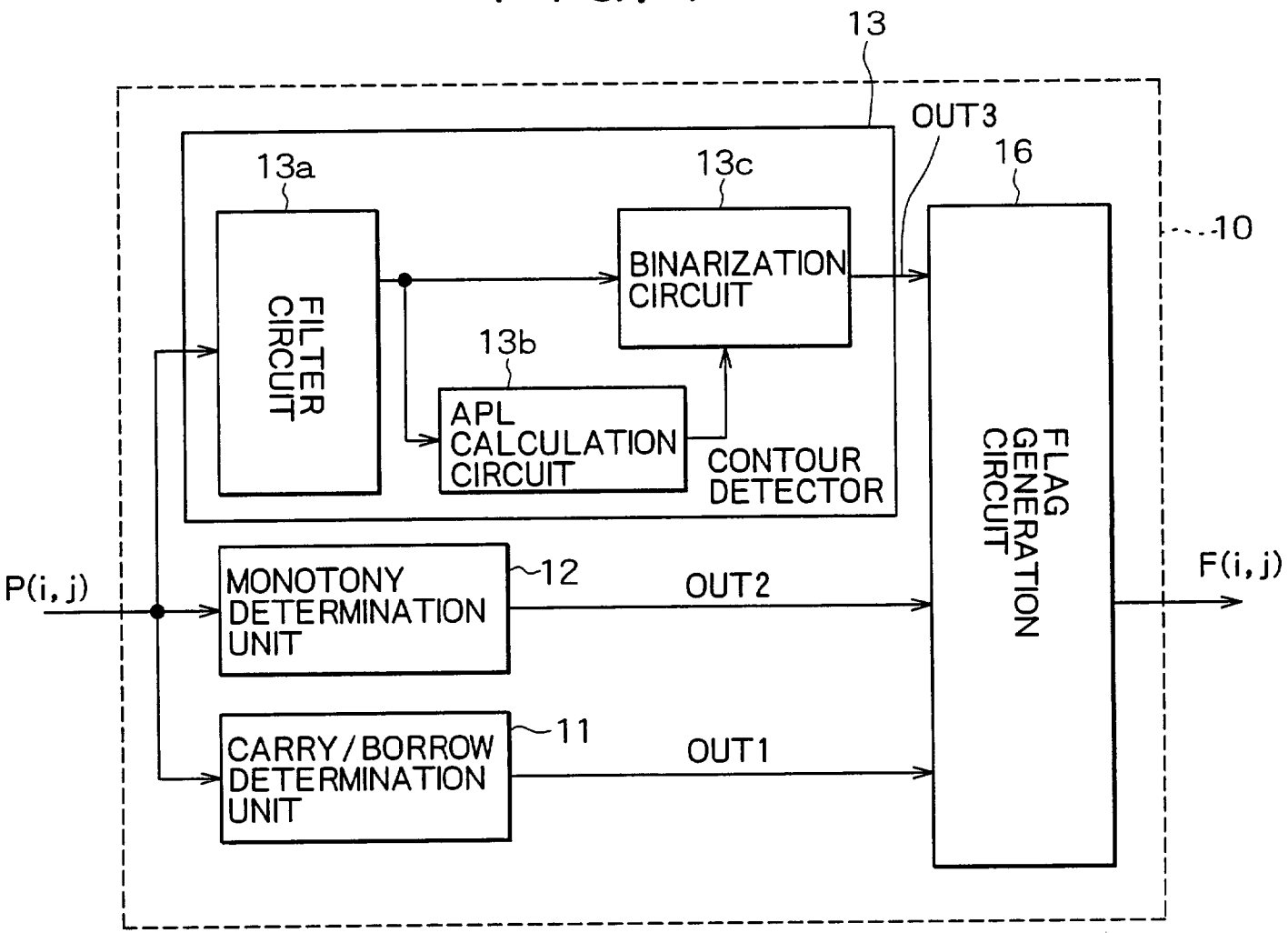
FIG. 4 is a block diagram showing a constitution of a dynamic false contour detector 10.

The following will describe the dynamic false contour detector 10. FIG. 4 is a block diagram showing a constitution of the dynamic false contour detector 10. The dynamic false contour detector 10 includes a carry/borrow determination unit 11, a monotony determination unit 12, and a contour detector 13. The carry/borrow determination unit 11 receives a pixel value (a gradation level) P(i,j) of a pixel A(i,j), which is on an ith column from the left and a jth row from the top on a display, for example. In the present specification, the number and the position of the row and the column represent those for pixels emitting light in the same color unless otherwise specified.

The carry/borrow determination unit 11 stores individual pixel values P(i+1,j), P(i+2,j), and P(i+3,j) for successive pixels A(i+1,j), A(i+2,j), and A(i+3,j) on the same row in addition to a pixel value P(i,j) for a pixel A(i,j), for example. The carry/borrow determination unit 11 refers to a carry/borrow determination table (FIG. 3) created based on the lookup table LUT shown in FIG. 2. The carry/borrow determination unit 11 sets an output signal OUT1 corresponding to the pixel A(i,j) to high when these four pixel values include cases specified in the carry/borrow determination table, and sets the output signal OUT1 corresponding to the pixel A(i,j) to low otherwise.

The carry/borrow determination table specifies cases where a result of comparison between the individual subfields representing the weights of neighboring pixels satisfies the following condition. Namely, this condition is set such that either a subfield with the highest or the second highest weight of one or more subfields emitting light for representing an upper gradation level (subfield group for upper level) is not included in one or more subfields emitting light for representing a lower gradation level (subfield group for lower level).

For example, for the gradation level 15 and the gradation level 16, since the subfields SF3 and SF4 representing the gradation level 15 are not included in the subfield representing the gradation level 16, and an upper subfield SF5 is selected for emitting light so as to represent the gradation level 16, the successive arrangement for the gradation level 15 and the gradation level 16 is specified in the carry/borrow determination table. Also, for the gradation level 15 and the gradation level 24, since the subfield SF3 representing the gradation level 15 is not included in the subfields representing the gradation level 24, and the subfield SF5 upper than the highest subfield SF4 for representing the gradation level 15 is selected for emitting light so as to represent the gradation level 24, the successive arrangement for the gradation level 15 and the gradation level 24 is also specified in the carry/borrow determination table.

On the other hand, for the gradation level 24 and the gradation level 31, since the subfields SF4 and SF5 representing the gradation level 24 represent the gradation level 31, the successive arrangement for the gradation level 24 and the gradation level 31 is not specified in the carry/borrow determination table.

Namely, the arrangements specified in the carry/borrow determination table are cases where the gradation levels for successive pixels have light emission/non-light emission states opposite to each other, and thus light emission distributions in terms of time are largely different from each other. When the line of sight passes along pixels whose light emission periods are opposite to each other, disturbance of the gradation is observed, and thus a false contour is generated.

Arrangements specified in the carry/borrow determination table may be determined without considering the light emission state for subfields whose weight is smaller than a predetermined value such as the subfields SF1 and SF2 whose weight is 2 or less.

The monotony determination unit 12 stores the individual pixel values P(i+1,j), P(i+2,j), and P(i+3,j) for the successive pixels A(i+1,j), A(i+2,j), and A(i+3,j) on the same row in addition to the pixel value P(i,j) for the pixel A(i,j), for example, as the carry/borrow determination unit 11. Then, the monotony determination unit 12 determines whether relationships represented by the expression 1 or 2 exists among these pixels.

$$P(i,j)<P(i+1,j)<P(i+2,j)<P(i+3,j) \quad (1)$$

$$P(i,j)>P(i+1,j)>P(i+2,j)>P(i+3,j) \quad (2)$$

An output signal OUT2 is set to high when a relationship prescribed in the expression 1 or 2 exists, and output signal OUT2 is set to low otherwise.

The contour detector 13 includes a filter circuit 13*a* which stores total of nine pixel values P(i−1,j−1), P(i,j−1), P(i+1, j−1), P(i−1,j), P(i+1,j), P(i−1,j+1), P(i,j+1), and P(i+1,j+1) in a 3×3 region around the pixel value P(i,j) for the pixel A(i,j) in addition to the pixel value P(i,j), for example, and then applies predetermined filtering to them. The type of the filter is not limited, and a filter such as a Robinson filter may be applied. FIGS. 5A through 5I are schematic diagrams showing filters used for the Robinson filter. For the Robinson filter, first, pixel values shown in FIG. 5A are respectively multiplied by values in a filter shown in FIG. 5B, and then the sum of the products are obtained. Then, in the same way, the pixel values shown in FIG. 5A are respectively multiplied by values in a filter shown in FIG. 5C to FIG. 5I, and then the sum of the products are obtained for the individual filters. Consequently, eight of the sums are obtained in total. Then, the maximum value of the eight sums is set to a resultant value of the filtering for the pixel A(i,j) (an output value from the filter circuit 13*a*).

The contour detector 13 includes an APL calculation circuit 13*b* for calculating an APL (average picture level) from the pixel values for the entire pixels constituting one field based on the output from the filter circuit 13*a*, and a binarization circuit 13*c* for receiving a threshold relating to the average picture level supplied from the APL circuit 13*b*, and the output from the filter circuit 13*a*. The binarization circuit 13*c* compares the threshold and the output from the filter circuit 13*a* with each other. Then, the binarization circuit 13*c* determines that the pixel is positioned on a contour, and thus sets an output signal OUT3 to low when the output from the filter circuit 13*a* is larger than the threshold. On the other hand, the binarization circuit 13*c* determines that the pixel is not positioned on a contour, and thus sets the output signal OUT3 to high when the output from the filter circuit 13*a* is smaller than the threshold.

The dynamic false contour detector 10 includes a flag generation circuit 16 for receiving the output signal OUT1 from the carry/borrow determination unit 11, the output signal OUT2 from the monotony determination unit 12, and the output signal OUT3 from the contour detector 13. The flag generation circuit 16 sets a flag F(i,j), which is an output signal, to on when all of the output signals OUT1, OUT2, and OUT3 are high for the pixel value P(i,j), and sets the flag F(i,j) to off otherwise. Namely, the flag F(i,j) is set to on only when the following three conditions are met.

(a) Pixel values P(i,j), P(i+1,j), P(i+2,j), and P(i+3,j) include a carry or a borrow.

(b) Pixel values P(i,j), P(i+1,j), P(i+2,j), and P(i+3,j) increase or decrease monotonically in this order.

(c) Pixels A(i,j), A(i+1,j), A(i+2,j), and A(i+3,j) are not positioned on a contour.

Figure 6:
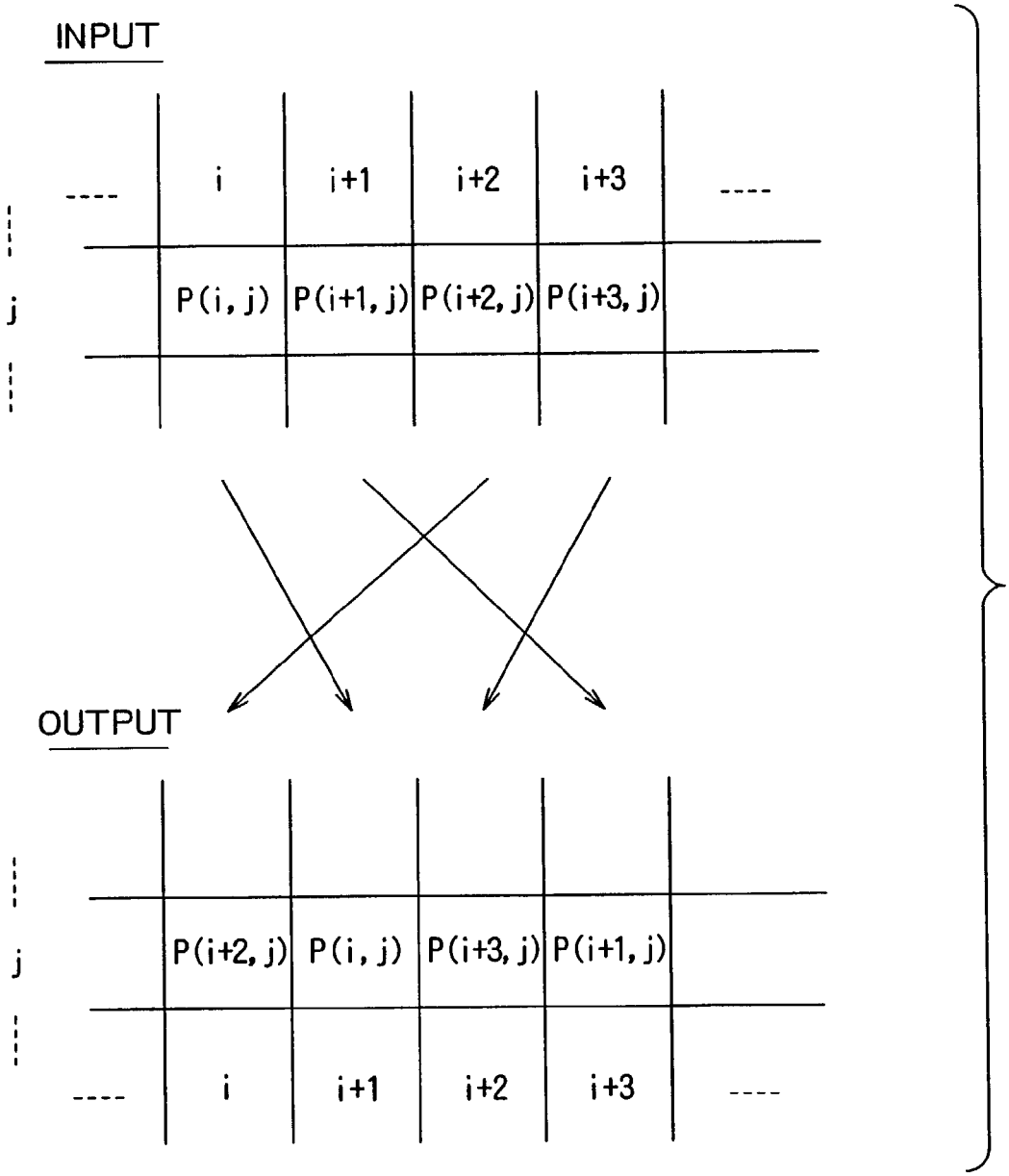
FIG. 6 is a diagram showing how to switch pixel values by a pixel value switcher 20.

The following section describes the pixel value switcher 20. The pixel value switcher 20 is a circuit which switches pixel values in a predetermined region of (m) rows×(n) columns including the pixel A(i,j) when the dynamic contour determination flag F(i,j) for the pixel A(i,j) is on. In the present embodiment, pixel values are switched in a region of one row×four columns as shown in FIG. 6, for example. Namely, when the flag F(i,j) is on, the pixel value for A(i,j) is P(i+2, j), the pixel value for A(i+1,j) is P(i, j), the pixel value for A(i+2,j) is P(i+3, j), and the pixel value for A(i+3,j) is P(i+1, j).

Then, the following section describes an identification method for a generated position of a dynamic false contour, and a processing method for an image signal as an operation of a processing apparatus for the image signal relating to the first embodiment constituted as described above.

In the present embodiment, pixel values P(i,j) for all pixels constituting one field are sequentially supplied for the dynamic false contour detector 10 and the pixel value switcher 20. Then, the dynamic false contour detector 10 determines whether the flag F(i,j) is on or off. When the flag F(i,j) is off, the pixel value switcher 20 simply supplies the pixel value P(i,j) as a pixel value P'(i,j). When the flag F(i,j) is on, the pixel value switcher 20 supplies a pixel value P'(i,j) obtained as a result of the switching shown in FIG. 6 applied to the pixel value P(i,j).

A case where there is a carry or a borrow between P(i,j) and P(i+1,j) is set to (a), a case where there is a carry or a borrow between P(i+1,j) and P(i+2,j) is set to (b), and a case where there is a carry or a borrow between P(i+2,j) and P(i+3,j) is set to (c). When the line of sight moves along the pixels A(i,j) to A(i+3, j), a difference between an image recognized visually and an original signal (referred to as disturbance in gradation) may be brighter than the original signal (referred to as brighter hereafter), or darker (referred to as darker hereafter).

When the line of sight moves, and pixels are switched by the pixel value switcher 20 shown in FIG. 6 for any one of cases (a), (b), and (c) in FIG. 7 as an example of the switching, resultant disturbance of gradation after switching is shown in FIG. 7. In FIG. 7, Δ represents disturbance in gradation toward a brighter (or darker) direction from the original signal (carry (or borrow)), and ▲ represents disturbance in gradation toward a darker (or brighter) direction from the original signal (borrow (or carry)).

As shown in FIG. 7, compared with the original image data supplied for the dynamic false contour detector 10 and the pixel value switcher 20 for any one of (a), (b), and (c), at least either the total number of borrows or the total number of carries increases, and simultaneously Δ and ▲ are arranged alternately, and thus the carries and the borrows are arranged alternately along the plurality of successive pixels in the row direction. Also, for any one of these cases, the absolute value of the difference between the numbers of carries and borrows is 1 or less (0 or 1).

With this first embodiment, since the dynamic false contour detector 10 detects a pixel where a dynamic false contour is expected to be generated based on image data for one field period, the conventional frame buffer required for detecting a pixel where a dynamic false contour is expected to be generated based on image data for the plurality of fields is eliminated. Thus, the cost is reduced. Also, it is possible to avoid a detection error which occurs when motion vectors are detected, and a resultant remarkable degradation of the image.

Also, since switching of pixel values by the pixel value switcher 20 presents the arrangement where carries and borrows appear alternately as shown in FIG. 7, the disturbance in gradation toward the brighter direction than the original signal, and the disturbance in gradation toward the darker direction cancel out each other, and the dynamic false contour is restrained.

Figure 8:
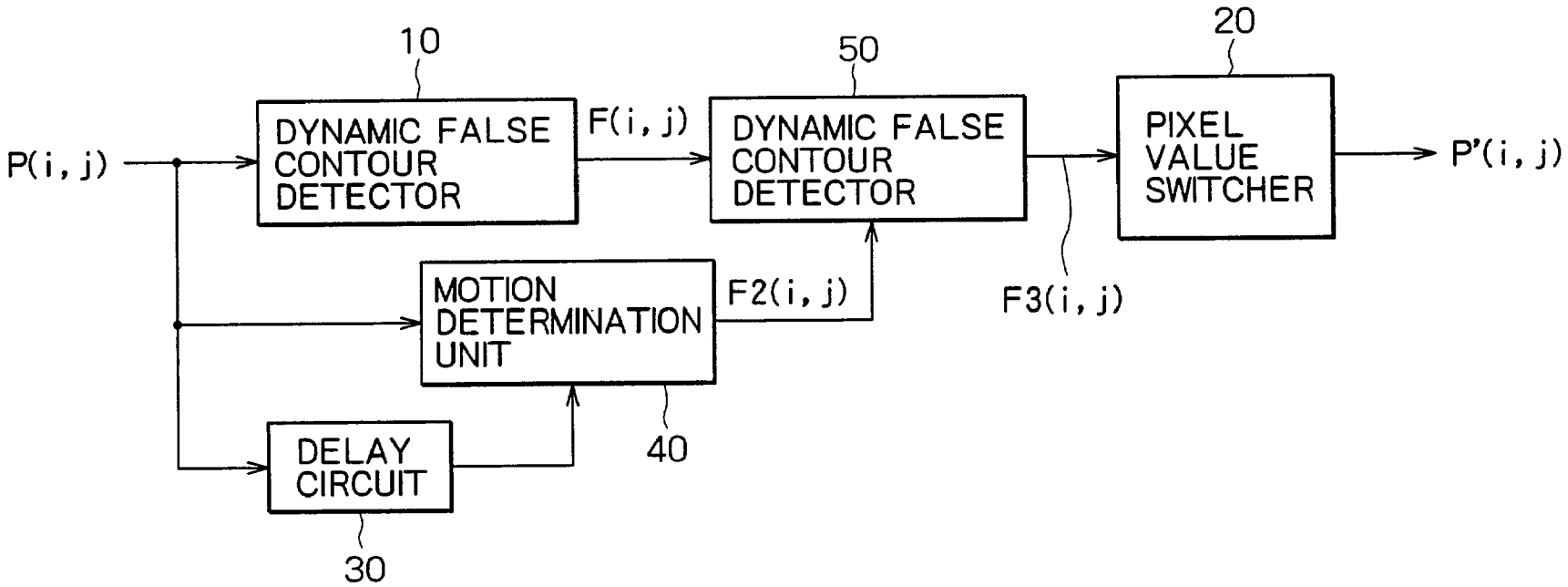
FIG. 8 is a block diagram showing a processing apparatus for an image signal according to a second embodiment of the present invention.

The following section describes a second embodiment of the present invention. The second embodiment uses a constitution which also uses motion vectors for identifying a position where a dynamic false contour is generated. FIG. 8 is a block diagram showing a processing apparatus for an image signal according to the second embodiment of the present invention. Constitution elements in the second embodiment shown in FIG. 8 identical to those in the first embodiment shown in FIG. 1 are assigned with the same reference numerals, and the description for them will not be provided.

The second embodiment includes a delay circuit 30 for supplying a pixel value P(i,j) after a delay of one field, and a motion determination unit 40 which detects a motion between two fields at a pixel A(i,j) based on the current pixel value P(i,j), and the pixel value P(i,j) which is one field before and is supplied from the delay circuit 30. A frame buffer may be used as the delay circuit 30, for example. The motion determination unit 40 sets a flag F2(i,j) to off when it detects a motion at the pixel A(i,j), for example, and sets the flag F2(i,j) to on otherwise. Further, a dynamic false contour detector 50 is provided between the dynamic false contour detector 10 and the pixel value switcher 20. The dynamic false contour detector 50 sets a flag F3(i,j), which is an output signal, to on only when both the flag F(i,j) supplied from the dynamic false contour detector 10, and the flag F2(i,j) supplied from the motion determination unit 40 are on. In the present embodiment, the pixel value switcher 20 determines whether to switch pixel values or not based on the flag F3(i,j). In the present embodiment, the delay circuit 30 and the motion determination unit 40 constitute a motion detection circuit.

In the second embodiment constituted in this way, the dynamic false contour detector 10 operates as in the first embodiment, and simultaneously the motion determination unit 40 compares the pixel value P(i,j) of the pixel A(i,j) in a field subject to the detection by the dynamic false contour detector 10, and the pixel value P(i,j) of the pixel A(i,j) in the preceding or following field so as to determine if they are identical or not. The motion determination unit 40 sets the flag F2(i,j) to on when both the pixel values are the same, and sets the flag F2(i,j) to off otherwise.

Then, the dynamic false contour detector 50 receives the flag F(i,j) supplied from the dynamic false contour detector 10, and the flag F2(i,j) supplied from the motion determination unit 40, and sets the flag F3(i,j), which is the output signal, to on only when the flag F(i,j) supplied from the dynamic false contour detector 10 is on, and the flag F2(i,j) supplied from the motion determination unit 40 is off.

Then, the pixel value switcher 20 supplies the pixel value P'(i,j) by conducting the same operation as in the first embodiment.

With the second embodiment, since the motion determination unit 40 detects whether the image is a still picture or not, and the pixel value switcher 20 does not operate when a supplied picture is still, it is possible to restrain degradation of the image quality of a still picture.

Though the image processing apparatuses according to the first and second embodiments conduct the detection of a dynamic false contour, and the processing of a signal based on the detection result both in the novel methods, the present invention is not limited to them. Thus, a dynamic false contour may be detected in a conventional way, and then the signal may be processed based on the detection result in the method according to the present invention. Or, a dynamic false contour may be detected in the method according to the present invention, and then the signal may be processed based on the detection result in a conventional way. In either case, the effect of the present invention is provided. For example, it is not always necessary to satisfy the expression 1 or 2 as the condition for the pixel values subject to switching, and thus dynamic false contour is restrained as long as Δ and ▲ appear alternately as a result of switching the pixel values.

The contour detection by the dynamic false contour detector 10 is conducted so as to prevent a contour from blurring, and is not always necessary for restraining a dynamic false contour. Also, it is preferable to turn off the flag for neighboring pixels as well as a pixel on which a contour exists for the entered image data when a contour is detected. This is because a contour may be blurred after the pixel value switcher 20 switches pixel values of the neighboring pixels if the flag is off only for the pixel on which the contour actually exits. Since the Robinson filter described before provides a relatively gentle peak, this filter is preferable for this processing. For example, when the filter is applied to 3×3 pixels, it is assumed that a contour exists in a region such as an 8×8 or 16×16 region, and the output signal OUT3 is set to low also for these pixels.

Figure 9A:
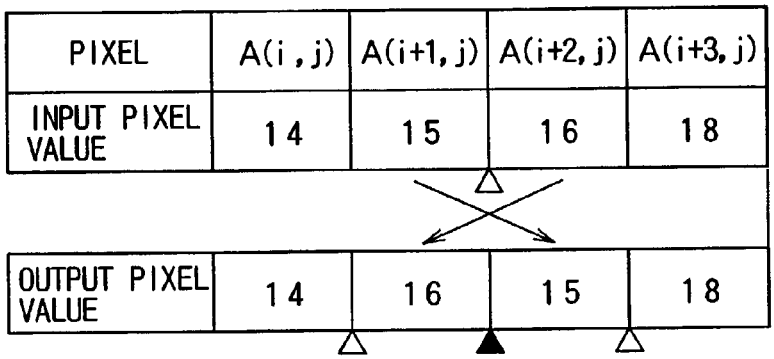
FIGS. 9A and 9B are diagrams showing an example of how to switch pixel values.
Figure 9B:
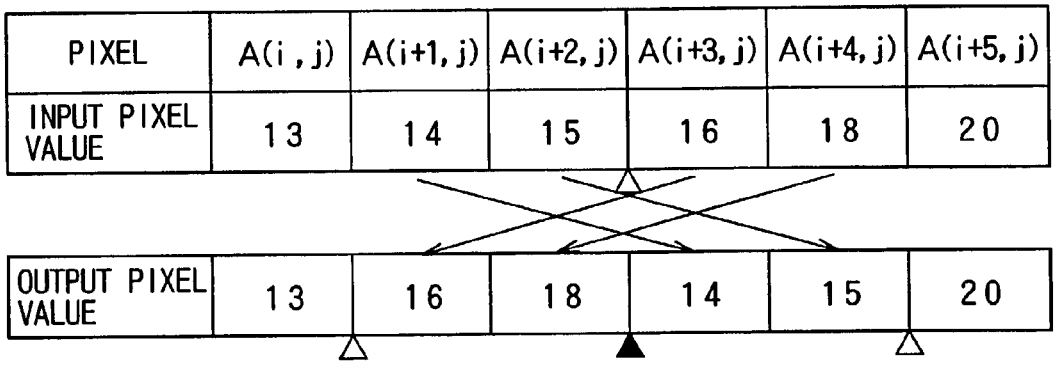

Further, the switching of the pixel values is not limited to the case shown in FIG. 6, and it is possible to switch pixel values for two pixels with each other as shown in FIG. 9A, or to switch pixel values for two pairs of pixels with each other as shown in FIG. 9B, for example. In FIGS. 9A and 9B, Δ shows a position where a carry exists, and ▲ shows a position where a borrow exits.

Further, the number of subfields constituting the one field period, and the number of gradation levels are not limited. For example, as shown in FIG. 10, seven subfields arranged in an order of luminance ratio of 1:2:3:4:5:7:9 may be used to represent 32 levels of gradation. Also, as shown in FIG. 11, it is possible to represent 64 levels of gradation by placing a subfield with the heaviest weight at the center of the one field, and arranging a pair of subfields with the same weight on the both sides of the subfield at the center. In this case, the existence of a carry and a borrow is determined based only on the weight of the subfield which emits light, and is not affected by the arranged position of the subfield.

Figure 12:
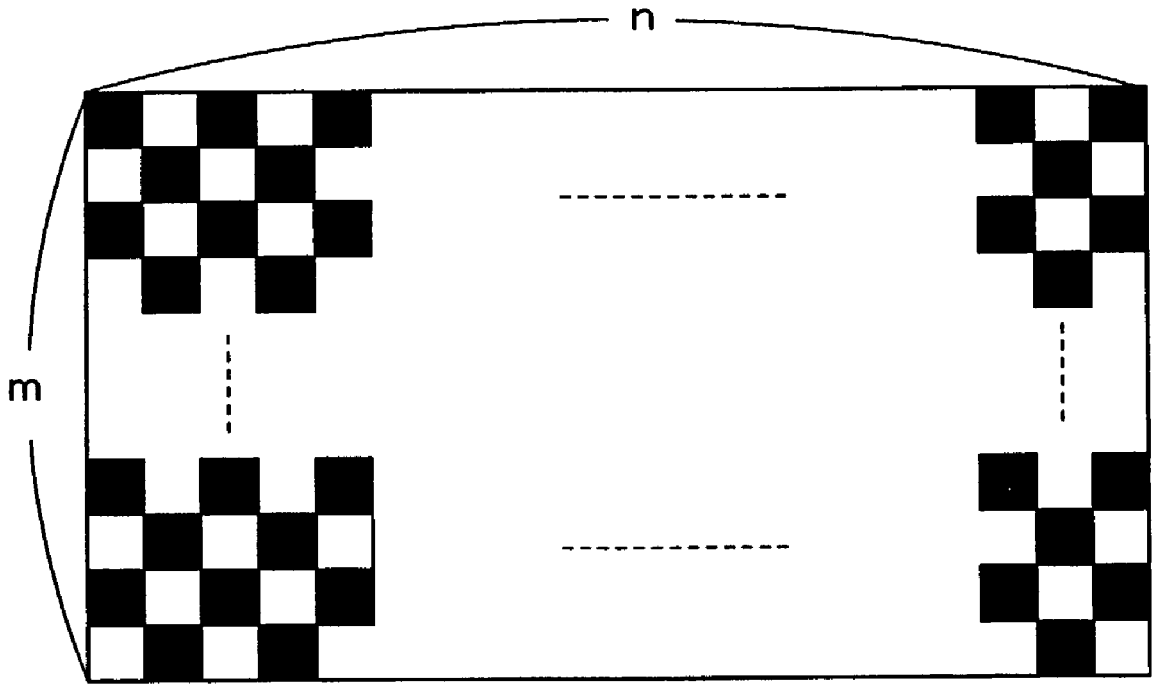
FIG. 12 is a schematic diagram showing disturbance of gradation in pixels arranged as a region of (m) rows×(n) columns.

Also, the switching of the pixel values is not limited to the pixels arranged along the row, and a similar effect is provided when the pixel values are switched in the column direction. The pixels to be switched may be those in an arbitrary successive (m) rows×(n) columns region. In this case, the pixel values are switched such that disturbance in gradation alternately appears in a checkered pattern as shown in FIG. 12.

Further, a display to which the present invention is applied is not limited to a plasma display, and the present invention may be applied to a display using the subfield method such as a mirror device and an organic EL display.

As detailed above, with the identification method for a generated position of a dynamic false contour according to the present invention, since it is possible to identify a position where a dynamic false contour is expected to be generated without a circuit for generating a delay for one field period such as a frame buffer, the structure of the apparatus is simplified.

Also, with the processing method for an image signal, or the processing apparatus for an image signal, it is possible to diffuse a dynamic false contour by switching the gradation levels. Thus, it is possible to restrain the degradation of the image caused by the dynamic false contour.

What is claimed is:

1. A method for processing an image signal in which one field period is divided into a plurality of subfields having different relative luminance ratios, and generating a plurality of gradation levels of an image by combining said subfields, the method comprising the steps of:

detecting a series of pixels in which the gradation level changes smoothly with respect to the pixel position in said one field period;

detecting neighboring two pixels which satisfy first and second predetermined relationships between said neighboring two pixels in the detected series of pixels in at least one subfield of said one field period, said first predetermined relationship being a relationship in which one or more subfields representing a gradation level of one of said neighboring two pixels do not include a subfield with a weight that is the same as a highest weight or second highest weight of one or more subfields representing a gradation level of the other of said neighboring two pixels, and said second predetermined relationship being a relationship in which said one or more subfields representing a gradation level of one of said neighboring two pixels include a subfield with a weight higher than said highest weight or second highest weight of one or more subfields representing a gradation level of the other of said neighboring two pixels; and changing an arrangement of the gradation levels among the detected series of pixels including the detected neighboring two pixels.

2. The method for processing an image signal according to claim 1, wherein only subfields with luminance higher than a predetermined value are used for detecting said neighboring two pixels.

3. The method for processing an image signal according to claim 1, wherein a region including the detected series of pixels is a region where the gradation level monotonically increases or decreases with respect to the pixel position.

4. The method for processing an image signal according to claim 1, wherein a region, including the detected series of pixels is a region where the gradation level monotonically increases or decreases with respect to the pixel position.

5. The method for processing an image signal according to claim 1, further comprising the step of detecting a contour in the series of pixels in said one field period, wherein, when the contour is detected, the arrangement of the gradation levels is not allowed to be changed among the detected series of pixels including the detected neighboring pixels.

6. The method for processing an image signal according to claim 5, wherein said step of detecting the contour includes the step of applying filtering to an image signal representing the gradation levels of the series of pixels.

7. The method for processing an image signal according to claim 1, further comprising the step of detecting a contour in the series of pixels in said one field period, wherein, when the contour is detected, the arrangement of the gradation levels is not allowed to be changed among the detected series of pixels including the detected neighboring pixels.

8. The method for processing an image signal according to claim 7, wherein said step of detecting the contour includes the step of applying filtering to an image signal representing the gradation levels of the series of pixels.

9. A method for processing an image signal in which one field period is divided into a plurality of subfields having different relative luminance ratios, and generating a plurality of gradation levels of an image by combining said subfields, the method comprising the steps of:

detecting neighboring two pixels which satisfy first and second predetermined relationships between said neighboring two pixels in a series of pixels in said one field period, said first predetermined relationship being a relationship in which one or more subfields representing a gradation level of one of said neighboring two pixels do not include a subfield with a weight that is the same as a highest weight or second highest weight of one or more subfields representing a gradation level of the other of said neighboring two pixels, and said second predetermined relationship being a relationship in which said one or more subfields representing a gradation level of one of said neighboring two pixels include a subfield with a weight higher than said highest weight or second highest weight of one or more subfields representing a gradation level of the other of said neighboring two pixels; and changing an arrangement of the gradation levels among the series of pixels including the detected neighboring two pixels, such that at least either a total number of pairs of neighboring two pixels satisfying said first and second predetermined relationships is increased by changing the arrangement.

10. The method for processing an image signal according to claim 9, wherein said step of changing an arrangement of the gradation levels is performed such that an absolute value of a difference between total numbers of first and second pairs of neighboring two pixels satisfying said first and second predetermined relationships is set to 0 or 1, said first pair and said second pair having opposite relationships with pixel position.

11. The method for processing an image signal according to claim 9, wherein said step of changing an arrangement of the gradation levels is performed such that first and second pairs of neighboring two pixels satisfying said first and second predetermined relationships are positioned alternately in the series of pixels, said first pair and said second pair having opposite relationships with pixel position.

12. The method for processing an image signal according to claim 9, wherein said step of changing an arrangement of the gradation levels is performed such that the gradation levels of two pixels are interchanged.

13. The method for processing an image signal according to claim 12, wherein said two pixels are next to each other.

14. An apparatus for processing an image signal in which one field period is divided into a plurality of subfields having different relative luminance ratios, and generating a plurality of gradation levels of an image by combining said subfields, the apparatus comprising:

a false contour detector for detecting neighboring two pixels which satisfy first and second predetermined relationships between said neighboring two pixels in a series of pixels in said one field period, said first predetermined relationship being a relationship in which one or more subfields representing a gradation level of one of said neighboring two pixels do not include a subfield with a weight that is the same as a highest weight or second highest weight of one or more subfields representing a gradation level of the other of said neighboring two pixels, and said second predetermined relationship being a relationship in which said one or more subfields representing a gradation level of one of said neighboring two pixels include a subfield with a weight higher than said highest weight or second highest weight of one or more subfields representing a gradation level of the other of said neighboring two pixels; and a pixel value switcher for changing an arrangement of the gradation levels among the series of pixels including the detected neighboring two pixels, such that at least either a total number of pairs of neighboring two pixels satisfying said first and second predetermined relationships is increased by changing the arrangement.

15. The apparatus for processing an image signal according to claim 14, further comprising a detector for detecting a series of pixels in which the gradation level changes smoothly with respect to the pixel position in said one field period, wherein said false contour detector detects said neighboring two pixels in the detected series of pixels.

16. The apparatus for processing an image signal according to claim 15, further comprising:

a motion detection circuit for detecting a motion in the image by comparing an image signal for said one field period with an image signal for one field period immediately before or after said one field period; and a second detector for determining whether or not to change said arrangement by using said pixel value switcher based on both of output signals from said detector and said motion detection circuit.

17. The apparatus for processing an image signal according to claim 14, wherein said pixel value switcher changes the arrangement of the gradation levels such that an absolute value of a difference between total numbers of first and second pairs of neighboring two pixels satisfying said first and second predetermined relationship is set to 0 or 1, said first pair and said second pair having opposite relationships with pixel position.

18. The apparatus for processing an image signal according to claim 14, wherein said pixel value switcher changes the arrangement of the gradation levels such that first and second pairs of neighboring two pixels satisfying said first and second predetermined relationships are positioned alternately in the series of pixels, said first pair and said second pair having opposite relationships with pixel position.

19. The apparatus for processing an image signal according to claim 14, wherein said pixel value switcher interchanges the gradation levels of two pixels.

20. The apparatus for processing an image signal according to claim 19, wherein said two pixels are next to each other.

* * * * *